US005156032A

United States Patent [19]

Edgar

[11] Patent Number: 5,156,032

[45] Date of Patent: Oct. 20, 1992

[54] KEY ASSEMBLY FOR VEHICLE ANTI-THEFT SECURITY SYSTEM

[75] Inventor: James R. Edgar, Shorewood, Wis.

[73] Assignee: Briggs & Stratton Corporation, Milwaukee, Wis.

[21] Appl. No.: 550,376

[22] Filed: Jul. 10, 1990

[51] Int. Cl.[5] ..... E05B 19/00; E05B 49/00

[52] U.S. Cl. ..... 70/278; 29/451; 70/395; 70/413; 235/375; 235/380; 235/382; 235/492; 340/825.31

[58] Field of Search ..... 70/395, 413, 278; 29/451; 340/825.31; 235/375, 380, 382, 492

[56] References Cited

U.S. PATENT DOCUMENTS

| | | | |
|---|---|---|---|
| 1,059,759 | 4/1913 | Preston | 70/413 |
| 1,438,839 | 12/1922 | Levey | 70/460 |
| 2,065,468 | 12/1936 | Keil | 40/330 |
| 3,309,549 | 3/1967 | Bluemink | 29/451 |
| 4,148,372 | 4/1979 | Schroeder | 70/DIG. 46 X |
| 4,333,327 | 6/1982 | Wake | 70/413 X |
| 4,868,559 | 9/1989 | Pinnow | 70/278 X |
| 5,083,362 | 1/1992 | Edgar et al. | 70/278 X |

*Primary Examiner*—Lloyd A. Gall

*Attorney, Agent, or Firm*—Andrus, Sceales, Starke & Sawall

[57] ABSTRACT

A key assembly for vehicle anti-theft security system includes a mechanical key having a through aperture for receiving a resistor pellet which is inserted in the aperture and mechanically secured by swaging or staking the key material adjacent the aperture to force key material into engagement with the outer perimeter of the resistor pellet.

4 Claims, 1 Drawing Sheet

KEY ASSEMBLY FOR VEHICLE ANTI-THEFT SECURITY SYSTEM

BACKGROUND OF THE INVENTION

The present invention relates to vehicle anti-theft security (VATS) systems, and more particularly, to a key assembly for use in an automobile steering column ignition and lock unit.

The development of numerous different electronic VATS systems for an automobile has taken place over the years. One such system incorporates the use of a resistor pellet in an ignition key. The pellet provides for a resistor of known resistance so that upon insertion and rotation of the key in an automobile's ignition cylinder unit an electrical current is applied to and through the resistor. A decoding circuit performs a resistance comparison between the pellet in the key and a known resistance "window" in the circuit. If the resistance is within the window, the automobile may be started. If the resistance does not match, the automobile will not start.

The current art provides for attachment of the pellet by sonic welding techniques. A problem with this type of attachment is that flashing, caused by sonic welding, from the plastic material comprising the outer portion of the pellet, could cover the exposed metal surface contacts of the resistor imbedded in the plastic material. If the contacts become covered, they are not capable of completing the decoding circuit and the automobile will not start even if the operator has the correct key. Further, the sonic weld could be weakened as a result of poor alignment of parts or contamination of surfaces by oil and humidity, for example.

Another potential problem is a bad solder attachment. There could be a short solder joint, creating a weakness in the attachment of the resistor to the metal contacts. A further problem is the possibility of heat from the sonic welding causing the solder which joins the exposed contacts within the pellet to break, resulting in an inoperative key.

SUMMARY OF THE INVENTION

In the present invention, a resistor pellet is frictionally attached in an aperture in an ignition key with a greater holding force than prior art sonic welding techniques. The force preferably is provided by a means disposed along the interface between the inner edge of the aperture and the outer surface of the pellet, and in one form comprises compression of the body of the pellet by staking or swaging an edge margin adjacent the aperture to form one or more integral inwardly projecting bosses that squeeze or pinch the pellet body to hold it in place. The compression of the pellet body provides sufficient force to prevent pellet detachment under normal use conditions.

The present invention thus provides for a more stable and controlled attachment with superior processing capability.

It is a feature and an advantage of the present invention to provide improved attachment of a resistor pellet in a key member.

It is a further feature and an advantage of the present invention to provide flash free attachment.

It is a further feature and an advantage of the present invention to provide lower costs of production and assembly.

It is a further feature and an advantage of the present invention that it is immune to contamination which may occur when using welding techniques.

It is a further feature and an advantage of the present invention to provide an aesthetic key assembly.

These and other features and advantages of the present invention will be apparent to those skilled in the art from the following detailed description of the preferred embodiment and the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
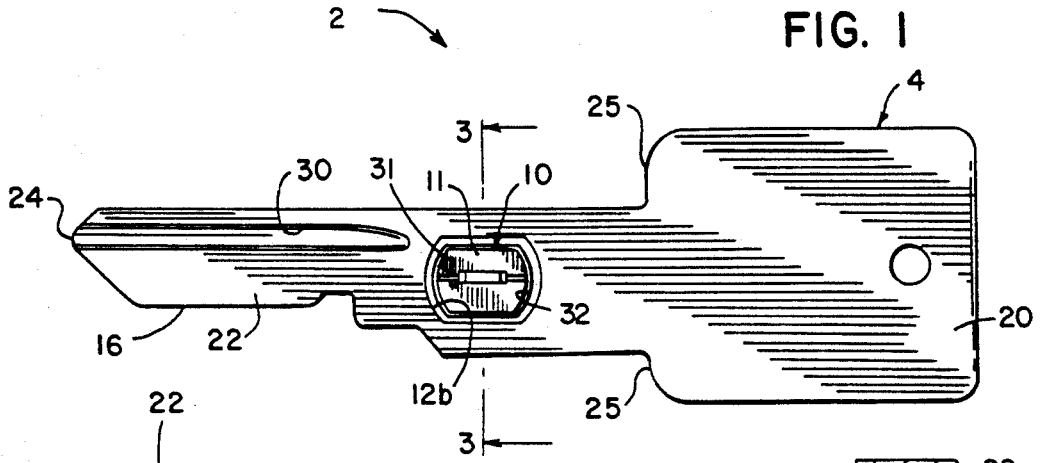
FIG. 1 is a side view of a key incorporating a pellet attached in accordance with the present invention.

As shown in FIG. 1, key assembly 2 comprises key member 4 and a glass-filled polyester "pellet" 10 disposed inside an aperture 6 formed in key member 4.

Key member 4 has a rectangular "head" 20 located at one end. Head 20 is proportioned larger than the rest of key member 4 and is used for gripping by the fingers of a person who will use key member 4. The larger dimension of head 20 allows for more space for a user's fingers to hold onto and for more torquing power when key member 4 is turned. As illustrated, key member 4 is to be employed with a cylinder ignition unit of an automobile although it could also be employed with other types of security systems.

The other end or "shank" 22 of key member 4 is typically inserted into a keyway of a cylinder ignition unit of an automobile. Shank 22 extends between tip 24 and shoulder 25 of key member 4.

Key member 4, as shown in FIG. 1, is called a key blank since it has yet to be notched. "Notching" means that small angular bits will be formed in shank 22 along edge 16. These bits will vary in depth and shape from key member to key member which will allow a single bitted or notched key to open only a specific lock or turn only a particular cylinder of an ignition starting unit. Another key with a different bitting or notching will not open the same lock or start the same ignition. Groove 30 in shank 22 is another standard security feature of key member 4. Groove 30 is typically disposed on both sides of shank 22 and is shaped to fit into specific types of keyways.

Figure 2:
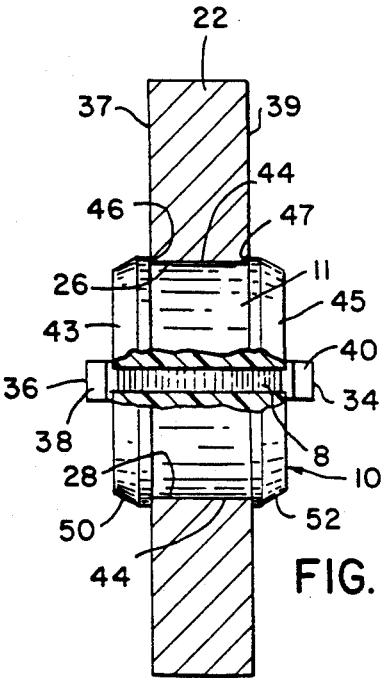
FIG. 2 is an enlarged cross sectional view of the key prior to attachment of the pellet to the key with the pellet shown in full having a portion thereof broken away to illustrate details of the conductor.
Figure 3:
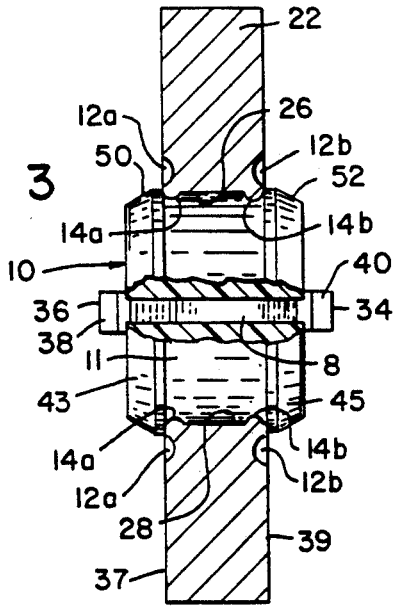
FIG. 3 is a cross sectional view similar to FIG. 2 taken along line 3—3 in FIG. 1 illustrating the pellet after attachment to the key.
Figure 4:
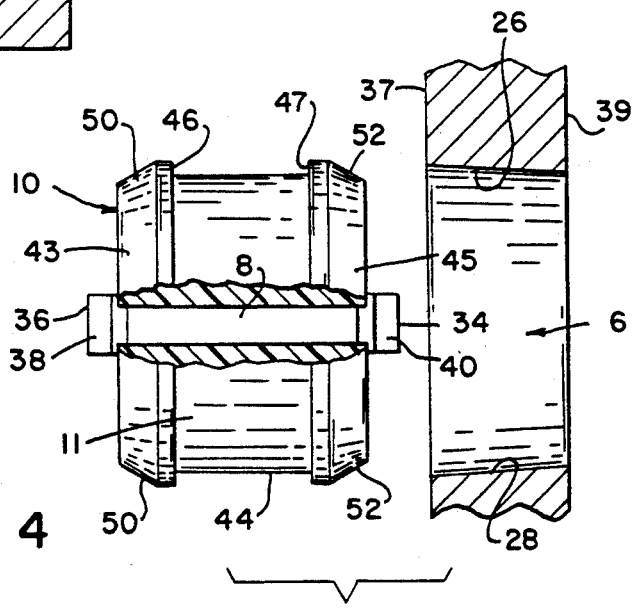
FIG. 4 is a schematic fragmentary cross sectional view of the key with the pellet shown in full having a portion thereof broken away to show details of the conductor illustrating the pellet and aperture prior to pellet insertion.

A unique feature of key member 4 is aperture 6 (see FIGS. 2–4). Aperture 6 is located in shank 22 near the back end of groove 30. Aperture 6 is generally rectangular shaped and includes upper and lower straight edges 26, 28 respectively, and front and back arcuate edges 31, 32 respectively. Aperture 6 extends through shank 22 and communicates with opposite sides 37 and 39 of key member 4 (FIG. 2).

As shown best in FIG. 4, edges 26, 28 of aperture 6 are tapered from side 37 to side 39 of key member 4 so that aperture 6 converges toward side 39. The distance between edges 26, 28 adjacent side 39 is less than the height of body 11 of pellet 10 so that when assembled body 11 frictionally engages edges 26, 28 and is compressed thereby a sufficient amount to secure pellet 10 in aperture 6 (as shown best in FIG. 2).

"Pellet" 10 is frictionally received within and contained within aperture 6 as best shown in FIGS. 2–4. Pellet 10 is also generally rectangular shaped and is dimensioned approximately the same as aperture 6. Pellet 10 includes a body 11 comprised of a deformable thermoplastic resin. Preferably body 11 is composed of a glass-filled polyester material and has a conductor or resistor element 8 imbedded therein and two heads 43, 45 at either end. Heads 43, 45 each form a circumferential ridge or shoulder 46, 47 respectively with respect to outer cylindrical surface 44 of pellet body 11. As a result, when pellet 10 is received within aperture 6, heads 43, 45 extend beyond opposite sides of aperture 6 with the compression of body 11, by edges 26, 28 providing an initial frictional retention force for pellet 10 in aperture 6 of key member 4, and shoulders 46, 48 centering pellet 10 in aperture 6. Each head 43, 45 also includes a tapered, lead-in surface 50, 52 which in combination with tapered edges 26, 28 aids in centering pellet 10 as it is inserted into aperture 6 from left to right as shown in FIG. 4.

Resistor 8 is used for conducting electricity from point 34 in FIG. 2 to point 36 or the reverse. Resistor 8 is a ceramic conductor in the preferred embodiment and the amount of resistance may be varied from pellet to pellet as is well known. Resistor 8 is electrically insulated from key member 4, which is made of brass, by the polyester body 11.

Resistor 8 in pellet 10 is interconnected with leads 38, 40 projecting from opposite sides of pellet 10. Leads 38 and 40 will touch other contacts (not shown) located in the steering column of an automobile when key member 4 is inserted into the keyway of an ignition cylinder, in the preferred embodiment. The automobile contacts will send an electrical current through one lead 38 into resistor 8 and out of opposite lead 40 on the other side. The resistance of element 8 will be measured by a decoding circuit, and if the resistance of pellet 10 matches the resistance "window" in the decoding circuit, the ignition circuit will close, and the automobile may be started.

Pellet 10 is preferably further secured within aperture 6 of key member 4 by a swaging procedure. In order to swage, key member 4 is placed in a press and is held tightly by an upper and a lower press member (not shown). Each press member is dimensioned and shaped the same as but slightly larger than aperture 6 and are positioned to fit around the edge margin of aperture 6 as the press members hold the key in place. Pellet 10 is inserted into aperture 6 and centered as shown in FIG. 2 and as described above.

The press members then compress further against opposite sides 37, 39 of key member 4 forming indentations 12*a* and 12*b* in opposite sides 37 and 39 respectively around aperture 6. As shown, (FIG. 3) indentations 12*a* and 12*b* surround aperture 6 on both sides 37, 39 of shank 22 in the preferred embodiment. However, the swaging procedure need take place along only a portion of aperture 6 if desired.

As key member 4 is swaged, material along the edge margin of aperture 6 is deformed or displaced such that integral bosses 14*a* and 14*b* are formed projecting into aperture 6 which engage surface 44 of body 11 and further compress body 11 to frictionally secure pellet 10 to key member 4. Pellet 10 is thereby frictionally attached within aperture 6 and may only be removed if a push out force greater than about 50 pounds is applied to pellet 10.

The description recited describes the securing means and the preferred embodiment. However, the swaging technique does not have to be applied around the entire pellet 10 as described. The swaging could take place at circumferentially spaced locations adjacent aperture 6 to form a plurality of spaced bosses which would frictionally secure the pellet to the key member. Alternately, the swaging operation could be performed along only one or two or three of the edges adjacent aperture 6.

Various modes of carrying out the invention are contemplated as being within the scope of the following claims, particularly pointing out and distinctly claiming the subject matter.

I claim:

1. A key assembly comprising:

a key member having opposite sides and an aperture formed therethrough communicating with said opposite sides;

conductor means including a conductive resistor element disposed within a semi-rigid non-conductive insulating body located with said aperture;

means for initially frictionally retaining said conductor means in said aperture, said initial retaining means comprising means for compressing said insulating body, said aperture converges from one side of said key member toward the opposite side of said key member to thereby define tapered edges and said initial retaining means comprises said tapered edges; and means for engaging and further compressing said body for securing said conductor means in said aperture.

2. The key assembly of claim 1 wherein said further compressing means comprises at least one boss projecting into said aperture engaging said body.

3. The key assembly of claim 2 wherein said boss is formed by swaging said key member.

4. The key assembly of claim 3 wherein said boss integrally projects along at least a portion of said tapered edges into said aperture.

* * * * *

UNITED STATES PATENT AND TRADEMARK OFFICE

CERTIFICATE OF CORRECTION

PATENT NO. : 5,156,032

DATED : October 20, 1992

INVENTOR(S) : James R. Edgar

It is certified that error appears in the above-identified patent and that said Letters Patent is hereby corrected as shown below:

IN THE CLAIMS:

| | |
|---|---|
| CLAIM 1 | Delete "with" and substitute therefore |
| Column 4, Line 41 | --- within --- |

Signed and Sealed this

Fifth Day of October, 1993

*Attest:*

*Attesting Officer*

Bruce Lehman

BRUCE LEHMAN

*Commissioner of Patents and Trademarks*